US008087410B2

(12) United States Patent
Gregory

(10) Patent No.: US 8,087,410 B2
(45) Date of Patent: Jan. 3, 2012

(54) METHOD AND PORTABLE SYSTEM FOR COOKING

(76) Inventor: Wayne Brian Gregory, Fallbrook, CA (US)

( * ) Notice: Subject to any disclaimer, the term of this patent is extended or adjusted under 35 U.S.C. 154(b) by 1364 days.

(21) Appl. No.: 11/704,533

(22) Filed: Feb. 9, 2007

(65) Prior Publication Data

US 2007/0199555 A1 Aug. 30, 2007

Related U.S. Application Data

(60) Provisional application No. 60/772,413, filed on Feb. 10, 2006.

(51) Int. Cl.
*F24C 1/16* (2006.01)

(52) U.S. Cl. ..... 126/275 E; 236/39 BA; 219/392; 219/393; 219/395; 219/452.11

(58) Field of Classification Search ..... 126/9 R, 126/38, 275 R, 19 R, 39 C, 373 R, 39 BA, 126/375 E See application file for complete search history.

(56) References Cited

U.S. PATENT DOCUMENTS

| | | | | | |
|---|---|---|---|---|---|
| 26,595 | A | * | 12/1859 | Danner et al. | 126/38 |
| 418,119 | A | * | 12/1889 | Fricker | 126/273 R |
| 695,979 | A | * | 3/1902 | Widmer | 126/38 |
| 1,373,828 | A | * | 4/1921 | Nottingham | 126/38 |
| 1,725,521 | A | * | 8/1929 | Keiner | 126/25 R |
| 2,154,305 | A | * | 4/1939 | Goerl | 126/38 |
| 2,517,254 | A | * | 8/1950 | Steele | 126/93 |
| 2,575,299 | A | * | 11/1951 | Scheel | 126/261 |
| 2,581,131 | A | * | 1/1952 | Naranick | 126/262 |
| 2,607,334 | A | * | 8/1952 | Perlman | 126/9 R |
| 3,051,159 | A | * | 8/1962 | Peters | 126/25 A |
| 3,094,113 | A | * | 6/1963 | Avila | 126/30 |
| 3,299,800 | A | * | 1/1967 | Angelo | 99/417 |
| 3,327,698 | A | * | 6/1967 | Freeland | 126/25 R |
| 3,359,963 | A | * | 12/1967 | Kostial | 126/9 R |
| 3,765,397 | A | * | 10/1973 | Henderson | 126/25 R |
| 4,094,295 | A | * | 6/1978 | Boswell et al. | 126/25 R |
| 4,300,444 | A | * | 11/1981 | Muse | 99/448 |
| 4,467,709 | A | * | 8/1984 | Anstedt | 99/482 |
| 4,495,860 | A | * | 1/1985 | Hitch et al. | 99/340 |
| 4,508,094 | A | * | 4/1985 | Hait | 126/9 R |
| 4,512,249 | A | * | 4/1985 | Mentzel | 99/352 |
| 4,649,811 | A | * | 3/1987 | Manganese | 99/417 |
| 4,903,683 | A | * | 2/1990 | Larsen et al. | 126/25 B |
| 4,909,235 | A | * | 3/1990 | Boetcker | 126/9 R |
| 5,284,126 | A | * | 2/1994 | Varney | 126/50 |
| 5,359,988 | A | * | 11/1994 | Hait | 126/25 R |
| 5,797,386 | A | * | 8/1998 | Orr | 126/25 R |
| D437,522 | S | * | 2/2001 | Measom | D7/354 |
| 6,962,106 | B2 | * | 11/2005 | Viraldo | 99/339 |
| 7,237,547 | B1 | * | 7/2007 | Bourgeois | 126/9 R |
| 2002/0043258 | A1 | * | 4/2002 | Sainz | 126/9 R |

* cited by examiner

*Primary Examiner* — Carl Price
(74) *Attorney, Agent, or Firm* — Bruce E. Weir

(57) ABSTRACT

A portable cooking system has a heating chamber supported by retractable legs that rest on a lid. A fire pan also resting on the lid and partially within the heating chamber is adaptable to burn charcoal, wood, or compressed gas. The lid supports and isolates the fire pan from the ground. The fire pan may be adapted for grilling. An alternate lid may contain an electric heating element. Thermometers and a vent on the heating chamber allow regulation on temperature within the heating chamber. The system may be adapted to provide uniform, controlled heat for Dutch ovens contained within. The system may also function as a smoker.

2 Claims, 18 Drawing Sheets

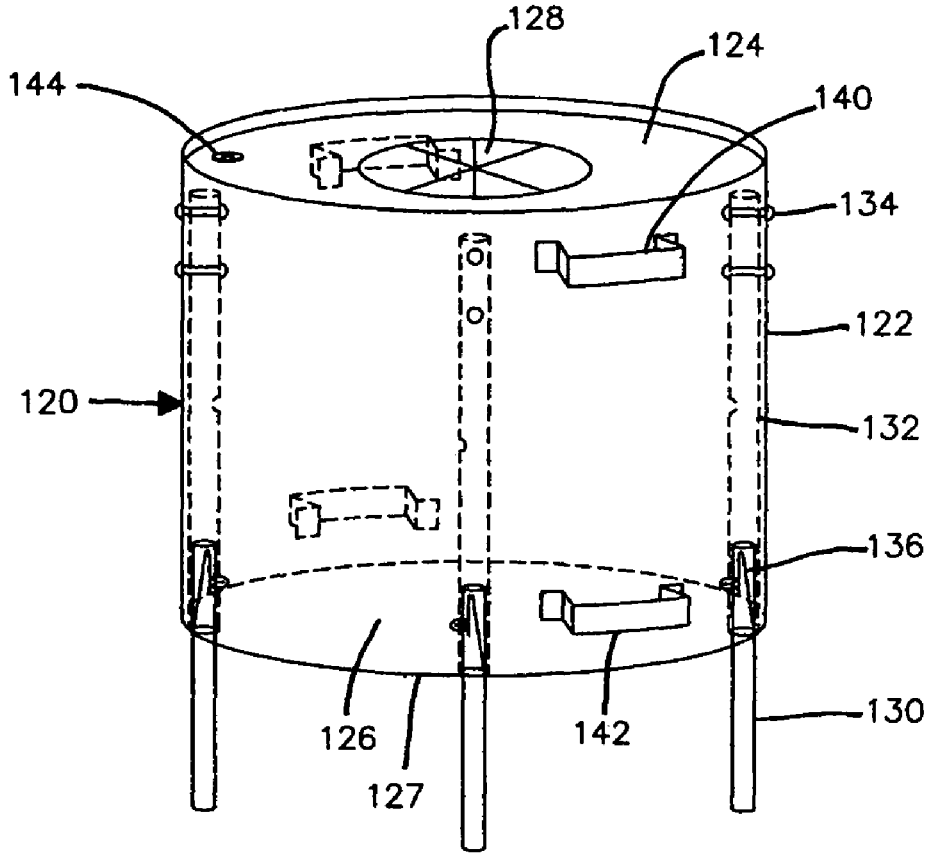
FIG. 1
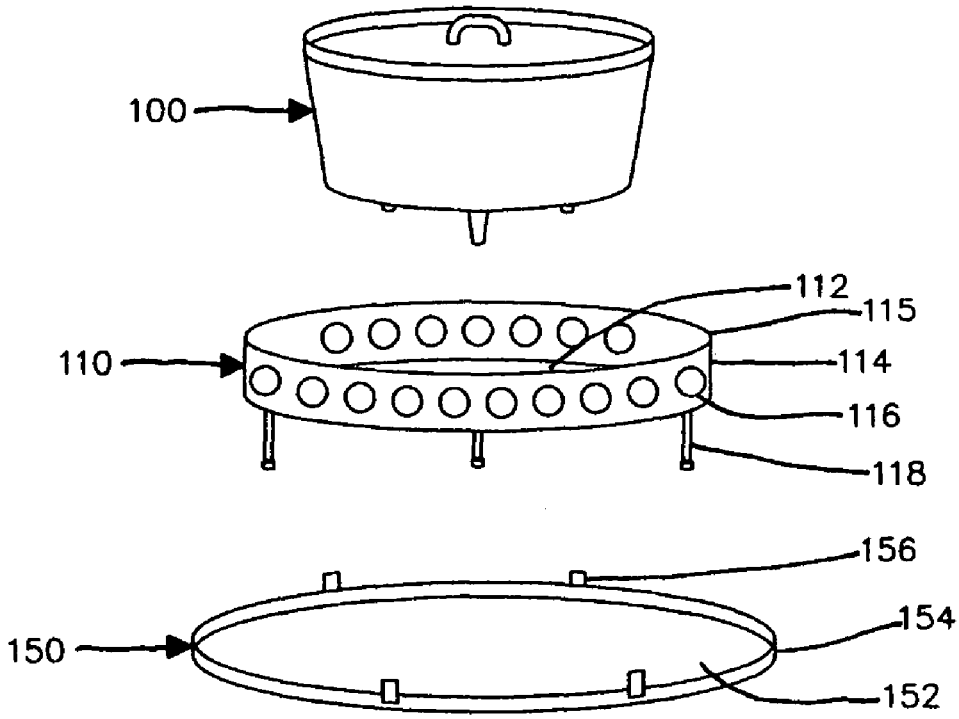

METHOD AND PORTABLE SYSTEM FOR COOKING

CROSS-REFERENCE TO RELATED APPLICATION

This application claims priority from provisional patent application Ser. No. 60/772,413, filed Feb. 10, 2006 by the same inventor, now pending.

BACKGROUND

Cooking without kitchen facilities can present a variety of difficulties. Open fires may be prohibited in certain areas. In other areas, such as parking lots or pristine natural places, cooking on the ground may be prohibited. Preferred fuels may be unavailable or banned. Wind and rain may make a fire difficult to light and maintain, and may dissipate heat. While portable stoves provide partial solutions to such problems, most gasoline or compressed gas stoves are poorly adapted to the specialized requirements of baking, smoking, and certain other food preparation methods.

For example, the Dutch oven provides a simple means for baking food with an open fire. However, variations in fuel, wind, and other conditions often make accurate regulation of the temperature within a Dutch oven difficult to achieve in the field. Traditional temperature regulation methods such as pit cooking may require considerable amounts of fuel, time, and experimentation, and may permanently scar the cooking site in an unacceptable manner. Cooking on the ground surface or a raised platform may leave the Dutch oven exposed to the wind. Gasoline and compressed gas stoves are rarely designed to support a Dutch oven and tend to concentrate too much heat on a very small portion of the oven surface.

Most existing cooking devices are designed for particular kinds of cooking, forcing a cook who wishes to employ different cooking methods to carry a variety of different devices or adaptors. The expense and inconvenience of purchasing, transporting, and using many incompatible or partially compatible devices strongly discourage cooks from using their full repertoire of cooking techniques in the field. What is needed is a cooking system that utilizes a variety of preferred fuels, can be reconfigured quickly to allow a cook to utilize a range of different cooking methods, and can be transported and stored in a configuration that is compact, easy to handle, and does not contaminate its surroundings with ash, soot, and other combustion products.

SUMMARY

The present invention mitigates these problems with a portable cooking system that can be configured to shield a fire pan from the ground and the interior of a heating chamber from the wind while regulating the flow and temperature of hot gasses within the heating chamber. The system is adaptable to burn carbon-based fuels such as charcoal, wood, or compressed gas, or to use an electric heating element. The fire pan may be adapted for grilling. The heating chamber may used as a grill stand. The system may be adapted to provide uniform, controlled heat for Dutch ovens contained within. The system may also function as a smoker.

BRIEF DESCRIPTION OF THE DRAWINGS

FIG. 1 shows an exploded perspective view of a heating chamber, a Dutch oven, a fire pan, and a lid.

DETAILED DESCRIPTION

Figure 2:
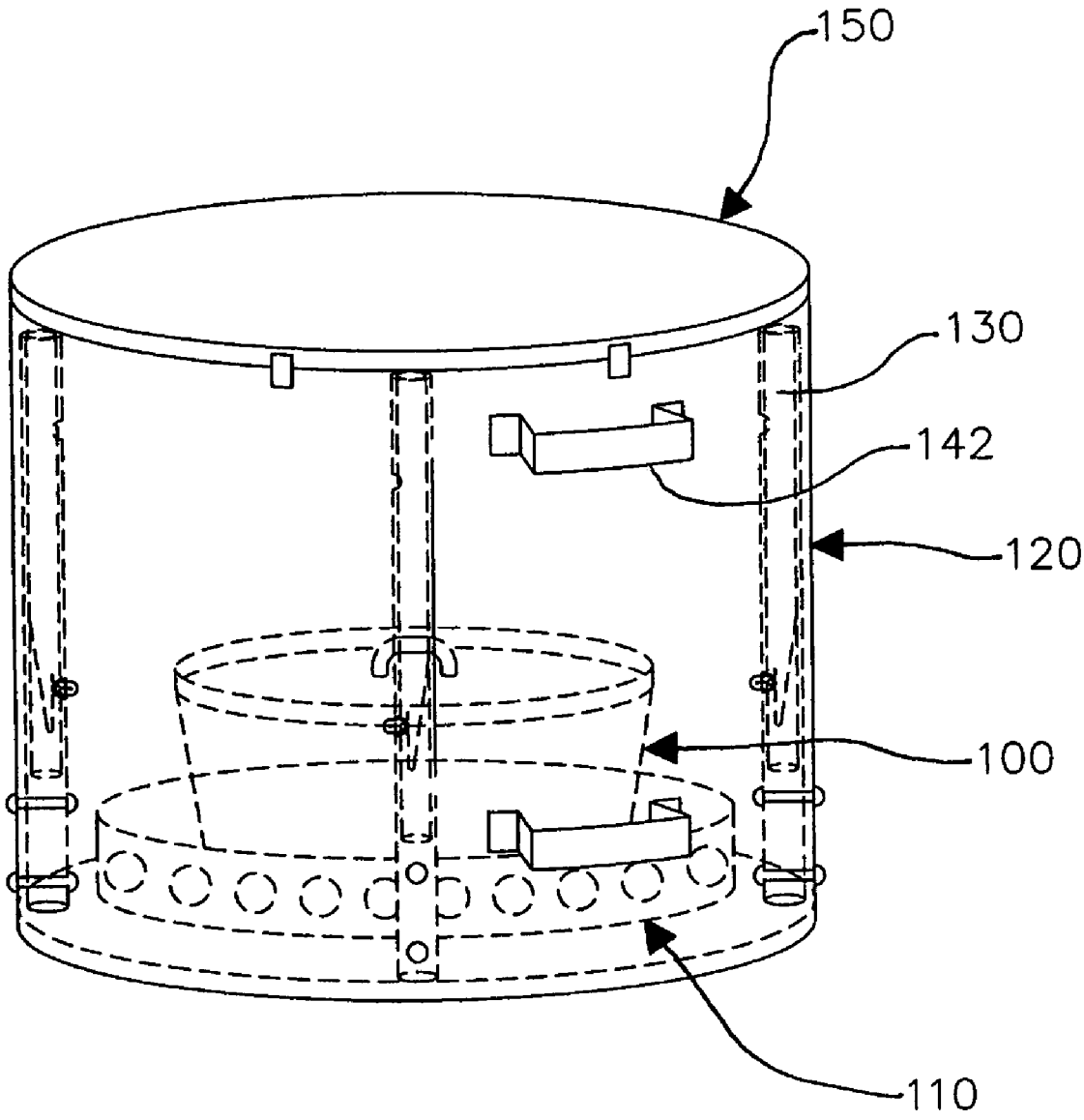
FIG. 2 shows a heating chamber, a Dutch oven, a fire pan, and a lid in a storage position.

FIG. 1 shows an exploded perspective view of a simple embodiment of an invention configuration for baking, with a heating chamber, a Dutch oven, a fire pan, and a lid. A Dutch oven 100 as is known in the art is received by a fire pan 110. The Dutch oven 100 rests upon the bottom 112 of the fire pan 110 and is partially surrounded by the fire pan's raised sidewall 114, which has vent holes 116 spaced at suitable intervals around its perimeter. The diameter of the fire pan 110 is approximately equal to or greater than the diameter of the Dutch oven 100.

Three or more fire pan legs 118 are screwed, welded or otherwise attached to the bottom 112 by means known in the art. The legs 118 may fold, retract, or detach entirely when not in use. The legs 118 may rest upon the ground or upon a lid 150. The legs 118 raise and isolate the bottom 112 of the fire pan 110 from the ground and allow ample air flow around the fire pan 110. The legs 118 may be of any suitable length, typically between one and four inches.

A heating chamber 120 fits concentrically over the Dutch oven 100 and fire pan 110. In this embodiment, the heating chamber 120 is a cylinder 122 with an open lower end 126 and an end panel 124 closing the upper end. In other embodiments, the shape and diameter of the heating chamber may vary to adjust airflow, locally concentrate or dissipate heat, stiffen the surface of the chamber, improve transportation and storage characteristics, and/or improve other properties of the system. In the embodiment of FIG. 1, the cylinder 122 diameter is preferably two to four inches greater than the diameter of the fire pan 110. The end panel 124 of the cylinder 122 has a vent 128 that allows air entering the open lower end 126 to pass upward through the cylinder 122 and exhaust into the atmosphere. The vent 128 may be a pie vent or other vent as is known in the art.

The heating chamber 120 is supported by at least three legs 130. In this embodiment, the legs 130 retract completely into tubes 132 attached to the interior of the cylinder 122 by fasteners 134 such as bolts or rivets. Channels, sleeves, and other configurations known in the art may serve in place of tubes 132. Extended legs 130 may be fixed in place by VALCO push inserts 136, set screws, or other positioning devices known in the art.

The heating chamber 120 may be manipulated with upper handles 140 and lower handles 142. In this embodiment, a thermometer 144 mounted on the end panel 124 of the cylinder 122 provides a measurement of the temperature of air circulating through the heating chamber 120.

In this embodiment the lid 150 is a disk 152 with a raised lip 154. The inside diameter of the lip 154 is slightly greater than the outside diameter of the cylinder 122, so that the lid 150 fits closely over the open lower end 126 of the cylinder 122. The lid may have latches 156 or other means known in the art for secure attachment to the cylinder 122.

The heating chamber 120, fire pan 110, and lid 150 may be made of steel, aluminum, and other known materials using fabrication techniques well-known in the art. Another simple embodiment of the invention may be fabricated from a metal trash can, with the barrel serving as the heating chamber 120 and the trash can lid serving as a lid 150. An engine oil collection pan of suitable dimensions may be modified to create a fire pan 110.

In use, the lid 150 is placed upon the ground to support the fire pan 110. Although the fire pan 110 may instead rest directly on the ground, positioning the lid 150 under the fire pan 110 protects the ground surface from scorching and ash deposits, which may allow a user to employ the present invention on asphalt, pristine soil, and other surfaces where damage would be unacceptable. Additionally, the lid 150 provides a stable platform on sand and other loose soils so that the legs 118 of the fire pan 110 do not settle into the soil.

The legs 118 of the fire pan 110 are extended to working positions. The fire pan 110 is placed upon the lid 150 and filled with a fuel (not shown) such as charcoal or wood. A Dutch oven 100 is centered upon the fuel and within the fire pan 110. Additional fuel may be deposited on top of the Dutch oven 100 in the usual manner. The fuel may be ignited before or after being placed within the fire pan 110. Depending on the length of the cylinder, up to four Dutch ovens 100 may be stacked, with fuel added atop each oven.

The legs 130 of the heating chamber 120 are extended and locked into position so that the lower edge 127 of the cylinder 122 will rest at a horizontal level slightly below the upper edge 115 of the fire pan's raised sidewall 114 when the legs 130 of the heating chamber 120 rest upon the lid 150. The slight horizontal overlap between the heating chamber 120 and the fire pan 110 directs external lateral air flow into the vent holes 116 while preserving vertical air flow from the fire pan 110 into the heating chamber 120.

The user grasps the heating chamber 120 by the upper handles 140 and places the heating chamber 120 over and surrounding the stacked Dutch ovens 100, with the legs 130 of the heating chamber 120 resting upon the lid 150. Heated air is drawn upward through and around the fire pan 110 into the heating chamber 120, continuing upward past and around the Dutch ovens 100. The vent 128 is adjusted to obtain desired air flow through and temperature within the heating chamber 120.

In addition to concentrating hot air where it is most effective, the heating chamber 120 provides a highly effective wind screen, promoting a consistent, regulated flow of heated air past the Dutch ovens 100. This embodiment of the invention thereby provides cooking conditions that are very similar to those found in conventional ovens, allowing users to more easily cook foods that are sensitive to cooking temperature. When the desired cooking time has elapsed, the user once again grasps the heating chamber 120 by the upper handles 140, lifts and removes the heating chamber 120, then removes each Dutch oven 100.

If the user is finished cooking, the legs 130 of the heating chamber 120 are fully retracted and the vent 128 is closed. The user grasps the upper handles 140 and places the heating chamber 120 over the fire pan 110 with the lower edge 127 of the cylinder 122 resting against the lid 150, thereby block airflow and extinguishing the fuel. After the fuel is consumed or extinguished and the fire pan 110 has cooled, the user grasps the lower handles 142 of the heating chamber 120 and inverts the chamber, so that the open lower end 126 is oriented upward.

The legs 118 of the fire pan 110 are removed, folded, or retracted and the fire pan 110 is placed within the inverted heating chamber 120. One or more Dutch ovens 100 may be stacked atop the fire pan 110. The lid 150 is inverted and placed over the upward-facing open lower end 126 of the heating chamber 120, thereby closing the chamber. Latches 156 or other fasteners may be used to hold the lid 150 in place.

In this manner the components of the invention may be conveniently stored and carried without loss of components or contamination of surroundings. FIG. 2 shows the embodiment of FIG. 1 in a storage position.

Figure 3:
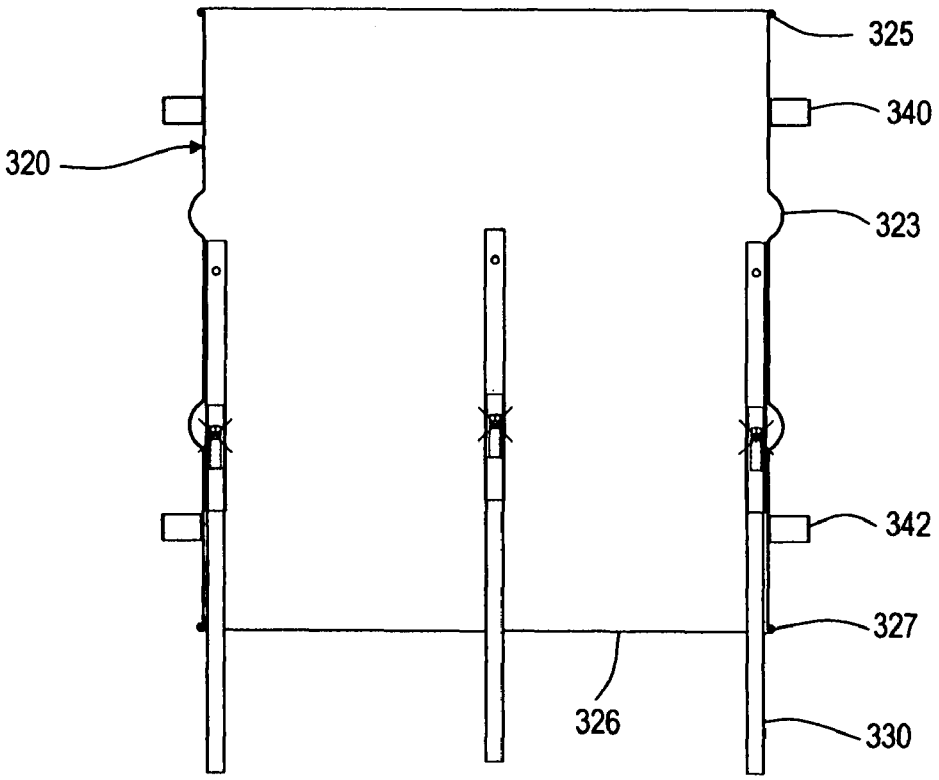
FIG. 3 shows a cross-sectional side elevation view of a heating chamber.
Figure 4:
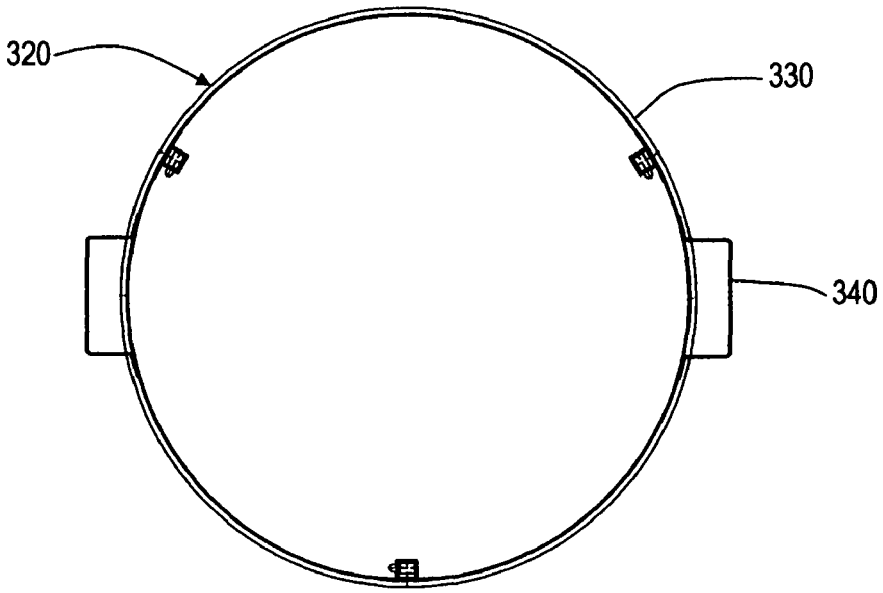
FIG. 4 shows a top plan view of the heating chamber of FIG. 3

The simple embodiment of FIGS. 1 and 2 can be improved in a number of ways. FIG. 3 is a cross-sectional side elevation view showing a heating chamber 320 with rolled upper 325 and lower 327 lips to strengthen the edges and with circumferential ribs 323 to stiffen the sides of the chamber. Upper 340 and lower 342 handles perform the same functions as their counterparts in FIG. 1. Although different embodiments of the invention might have more than three legs, the embodiment of FIG. 3 shows three legs 330 with the outer two depicted in positions 180 degrees apart for better visibility. However, as shown in the top plan view of FIG. 4, the three legs 330 are actually positioned approximately 120 degree apart. This convention is used for legs and feet in figures described below, with outer legs in side elevation views shown as if positioned 180 degrees apart, and actual circumferential positions shown in related top plan views.

Figure 5:
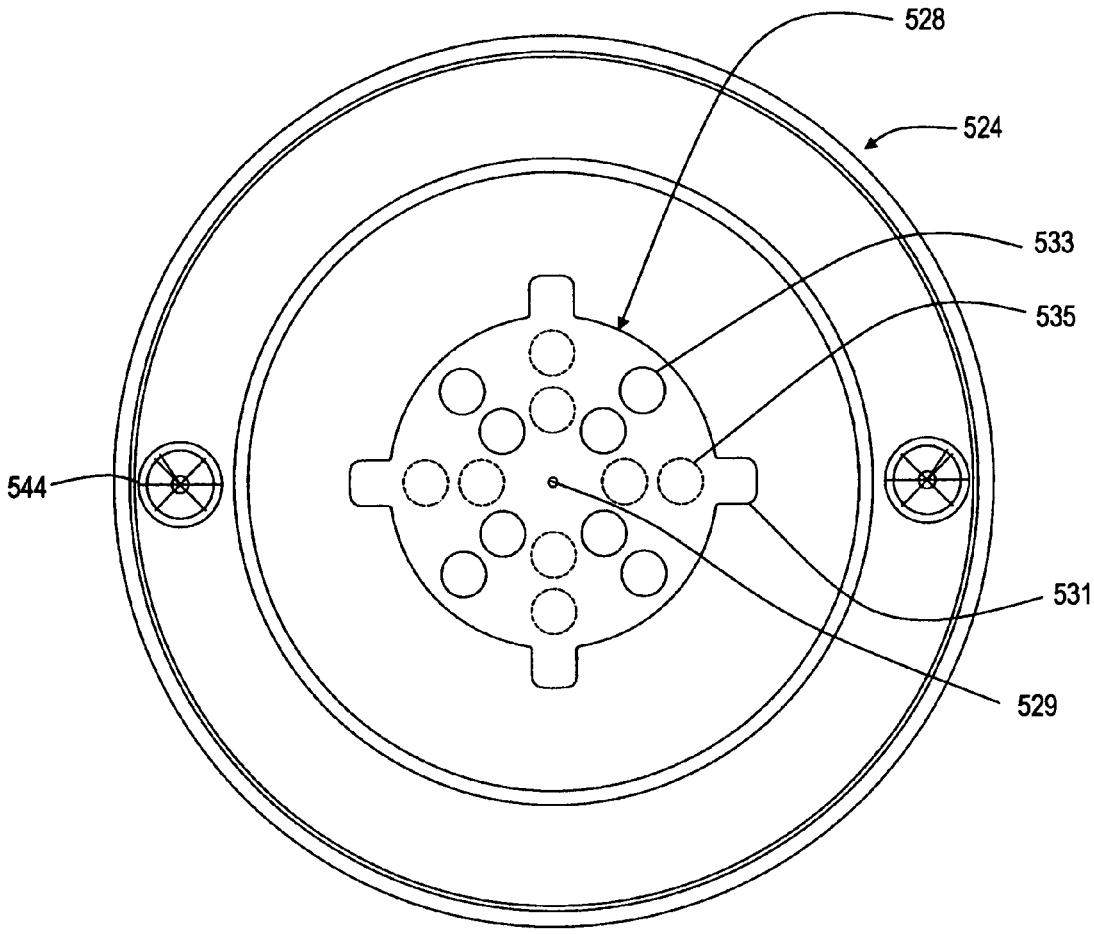
FIG. 5 shows a top plan view of an end panel.

FIG. 5 is a top plan view of an end panel 524 with two thermometers 544 and an adjustable vent 528. The vent 528 is rotatably attached to the end panel 524 with a fastener 529 such as a rivet or a bolt. When a tab 531 on the perimeter of the vent 528 is grasped and the vent 528 is rotated, holes 533 in the vent 528 align with holes 535 in the end panel 524 to allow air to pass through. The end panel 524 closes one end of the heating chamber 320 and may be affixed to the chamber 320 by means known in the art.

Figure 6:
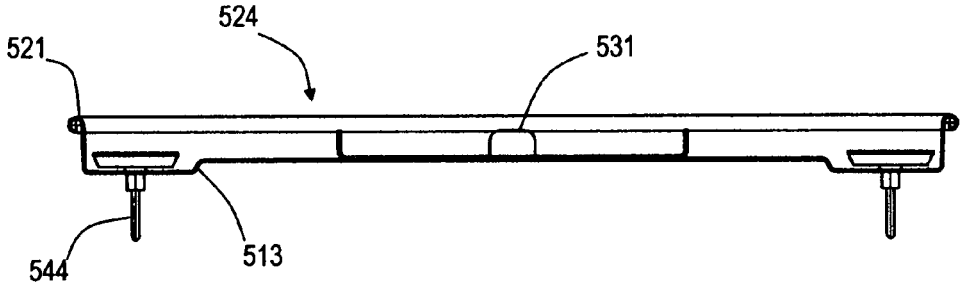
FIG. 6 shows a cross-sectional side elevation view of the end panel of FIG. 5.

FIG. 6 shows a cross-sectional side elevation view of the end panel 524 of FIG. 5. A circular step-down 513 is radially positioned within the feet of a fire pan (not shown) to center the fire pan when the system is in storage mode. A rolled lip 521 strengthens the exposed edge.

Figure 7:
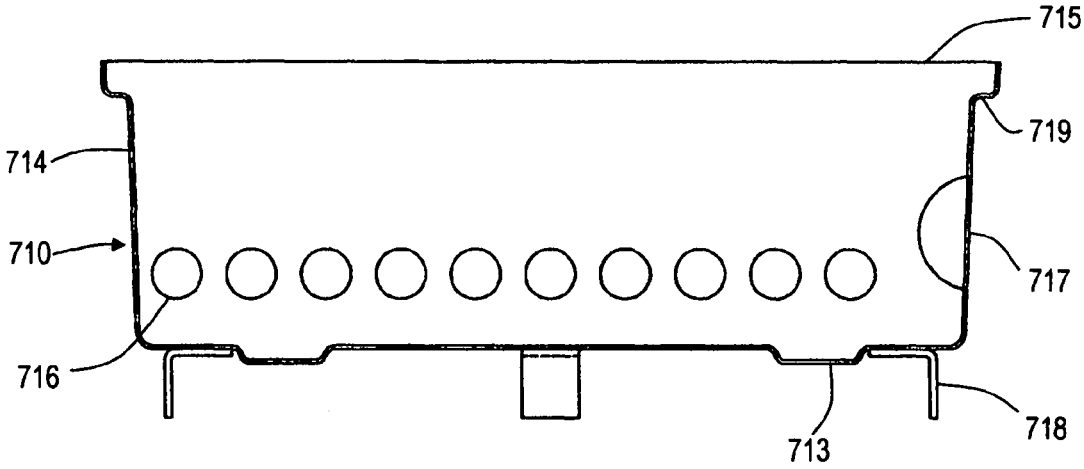
FIG. 7 shows a cross-sectional side elevation view of a fire pan.
Figure 8:
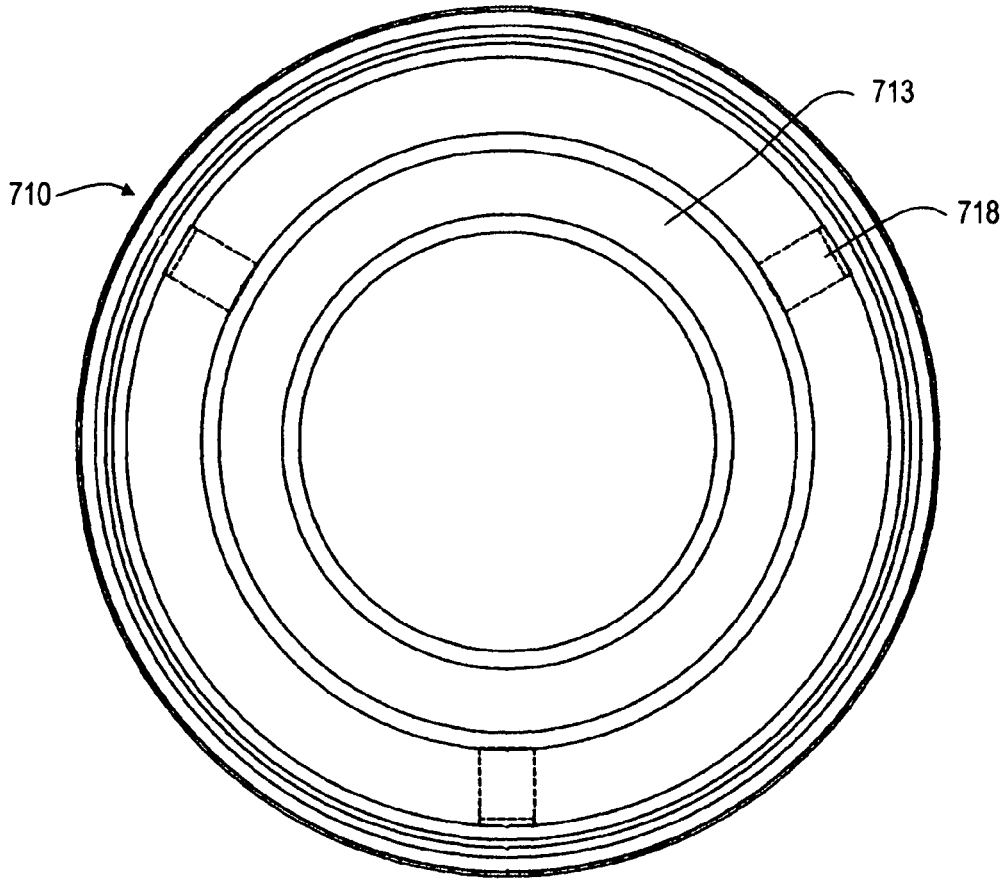
FIG. 8 shows a top plan view of the fire pan of FIG. 7.

FIG. 7 shows a cross-sectional side elevation view of a fire pan 710 with a ledge 719 formed slightly below the upper edge 715. Vent holes 716 arrayed around the sidewall 714 allow ingress of air. An access hole 717 is positioned to allow connection of an external fuel supply to a burner (not shown here) within the fire pan, as described below. Three or more feet 718 isolate the fire pan 710 from surfaces below. A pair of step-downs create a broad circular groove 713 in which the feet of differently-sized Dutch ovens may rest, thereby centering a Dutch oven with the fire pan 710. FIG. 8 shows a top plan view of the same embodiment and features.

Figure 9:
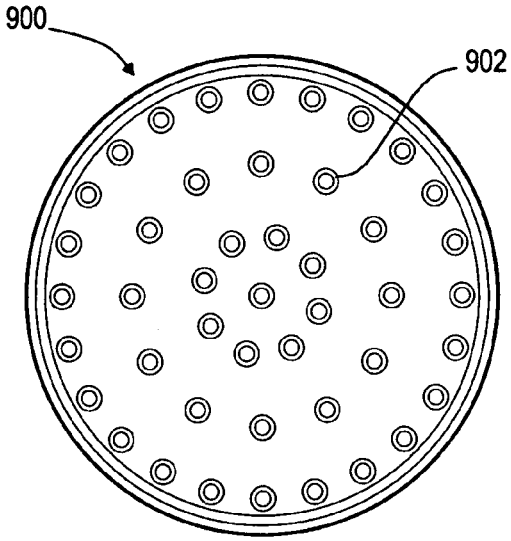
FIG. 9 shows a top plan view of a baffle.
Figure 10:
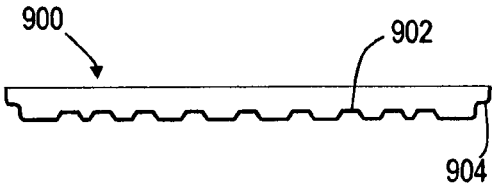
FIG. 10 shows a cross-sectional side elevation view of the baffle of FIG. 9.

FIGS. 9-13 show a fire pan with optional grilling inserts. FIG. 9 shows a top plan view of a baffle 900 with concentrically-arrayed of holes 902 to allow passage of hot gases from a heat source within a fire pan. FIG. 10 shows a cross-sectional side elevation view of the baffle 900 of FIG. 9. The edges of the holes 902 are raised to form a collection surface 903 that retains grease and other fluids from cooking food. A ledge 904 around the perimeter of the baffle 902 is sized and shaped to fit within the ledge 719 of the fire pan 710 of FIG. 7. The baffle 902 is preferably stiff enough to support three or more stacked Dutch ovens and may be made of any suitable material known in the art.

Figure 11:
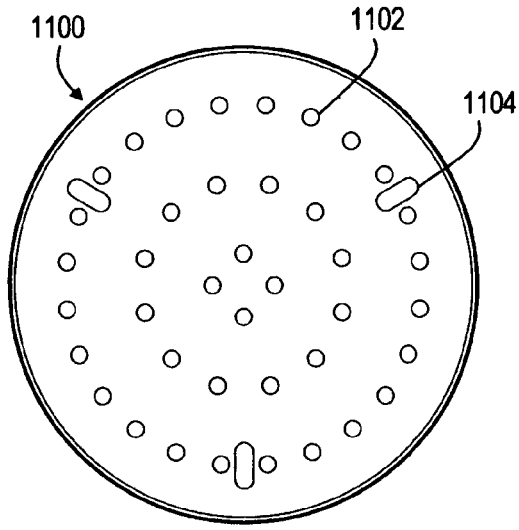
FIG. 11 shows a top plan view of a grill.
Figure 12:
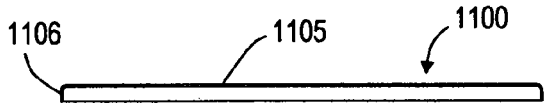
FIG. 12 shows a cross-sectional side elevation view of the grill of FIG. 11.
Figure 13:
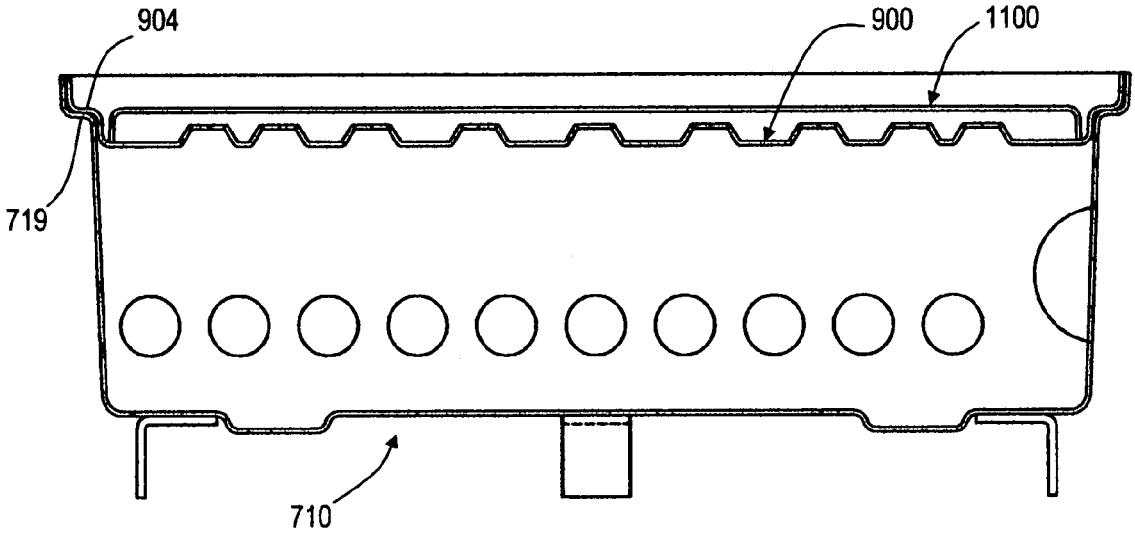
FIG. 13 shows a cross-sectional side elevation view of a fire pan with a baffle and grill installed.

FIG. 11 shows a top plan view of a grill 1100 sized and shaped to rest upon the baffle 900, just within the ledge 904. When the grill 1100 rests upon the baffle 900, holes 1102 in the surface of the grill 1100 are concentrically arrayed over the collection surface 903 of the baffle 900, so that no fluid can drip directly from the grill 1100 into the fire pan 710. Elongated holes 1104 in the grill 1100 are positioned to allow the legs of Dutch ovens of different sizes (not shown) to pass through the grill 1100 to rest directly upon the collection surface 903 of the baffle 900. FIG. 12 shows a cross-sectional side elevation view of the grill 900 of FIG. 11. A turned-down edge 1106 of the grill causes the grill surface 1105 to stand above and out of contact with the raised edges of the holes 902 in the baffle 900. FIG. 13 shows a cross-sectional side elevation view of a fire pan 710 with a baffle 900 and grill 1100 installed.

Figure 14:
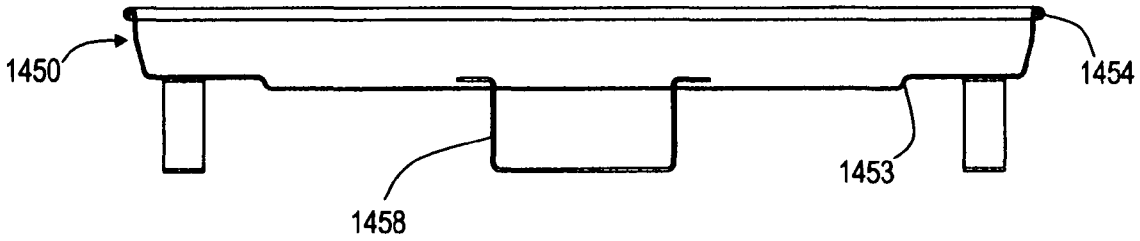
FIG. 14 shows a cross-sectional side elevation view of a lid with feet.
Figure 15:
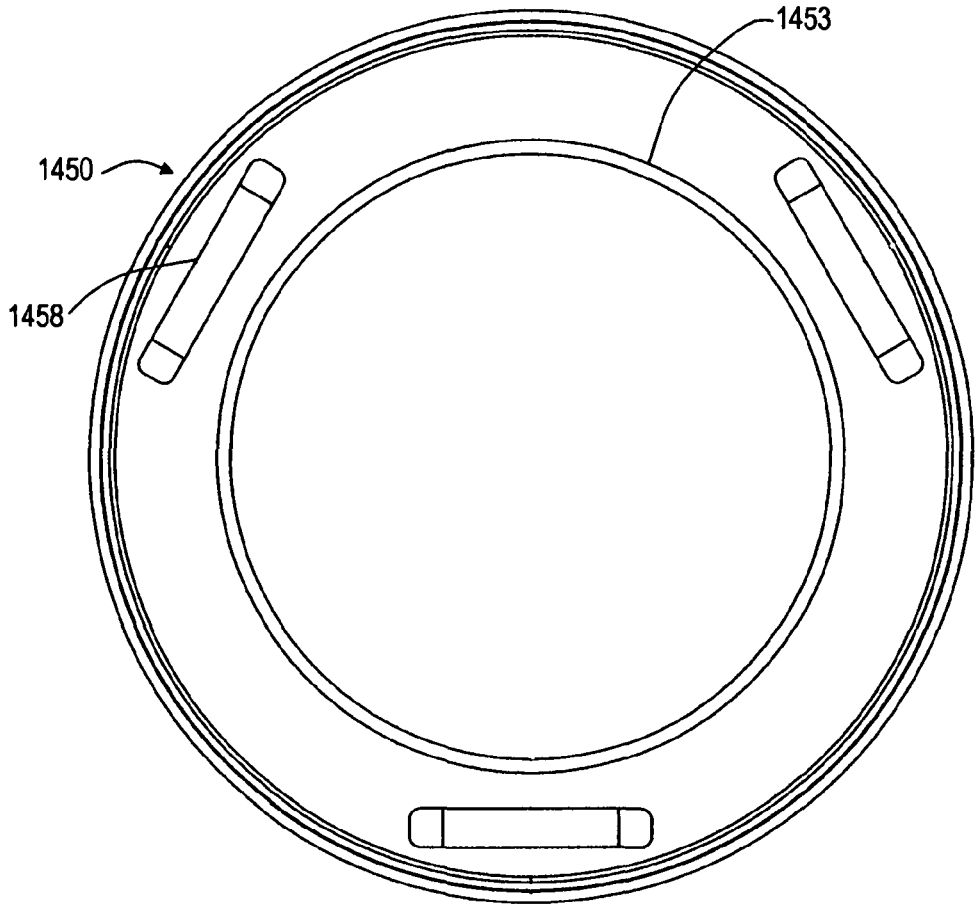
FIG. 15 shows a top plan view of the lid of FIG. 14.

FIG. 14 shows a cross-sectional side elevation view of a lid 1450 with feet 1458 that raise and isolate the lid 1450 from supporting surfaces. A rolled edge 1454 strengthens the upper edge of the lid 1450. A step-down 1453 centers the feet 718 of a fire pan 710 (not shown) resting on the interior of the lid 1450. FIG. 15 shows a top plan view of the embodiment and features of FIG. 14.

Figure 16:
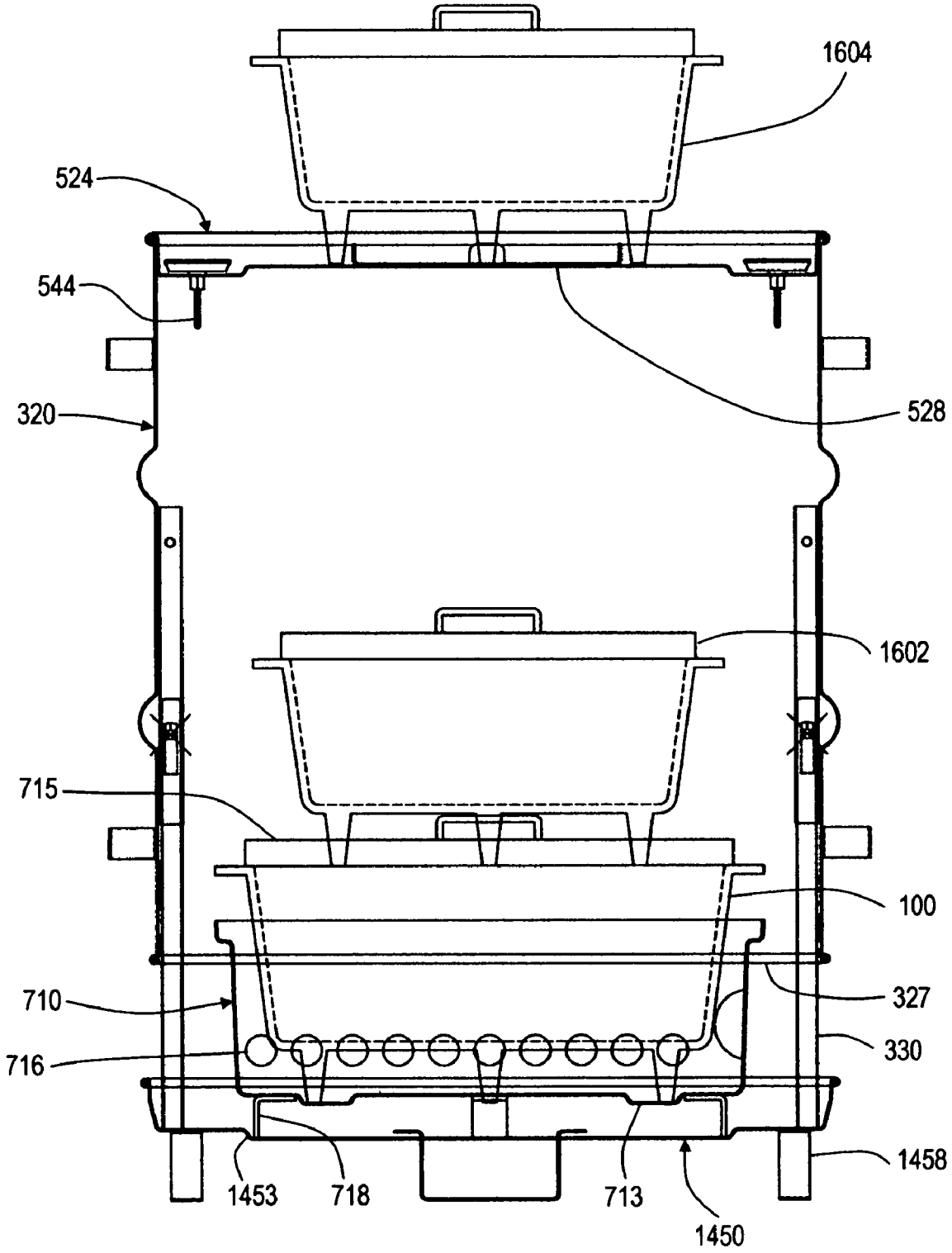
FIG. 16 shows a cross-sectional side elevation view of system for heating one or more Dutch ovens.

FIG. 16 shows a cross-sectional side elevation view with many of the components described above assembled into a system for heating one or more Dutch ovens. A heating chamber 320 with an end panel 524 has extended legs 330 resting upon a lid 1450. In this and subsequent similar views, the center leg is omitted to reduce clutter. The feet 718 of a fire pan 710 also rest upon the lid 1450 just within the centering step-down 1453. The feet of a Dutch oven 100 rest within the circular groove 713 of the fire pan 710. A second Dutch oven 1602 rests on top of the first Dutch oven 100. A third Dutch oven 1604 rests on top of the end panel 524. The lower edge 327 of the heating chamber 320 is set at a level slightly below the upper edge 715 of the fire pan 710.

With burning charcoal or wood around the first Dutch oven 100 and within the fire pan 710, air enters the fire pan 710 through the vent holes 716, is burned and heated, then rises through the heating chamber 320 and passes upward through the vent 528 in the end panel 524. The lid 1450 is thermally isolated from the supporting surface by feet 1458 and collects any ash that may fall through the vent holes 716. The fire pan 710 is thermally isolated from the lid 1450 by feet 718. Hot gasses rising from the fire pan 710 are protected from crosswinds by the overlap between adjacent edges of the heating chamber 320 and the fire pan 710. Temperature within the heating chamber 320 may be monitored with thermometers 524 and adjusted with the vent 528 and, if necessary, changes in leg 330 extension. The Dutch oven 1604 resting on the end panel 524 may be warmed while other ovens 100, 1602 are held at a higher temperature.

Figure 17:
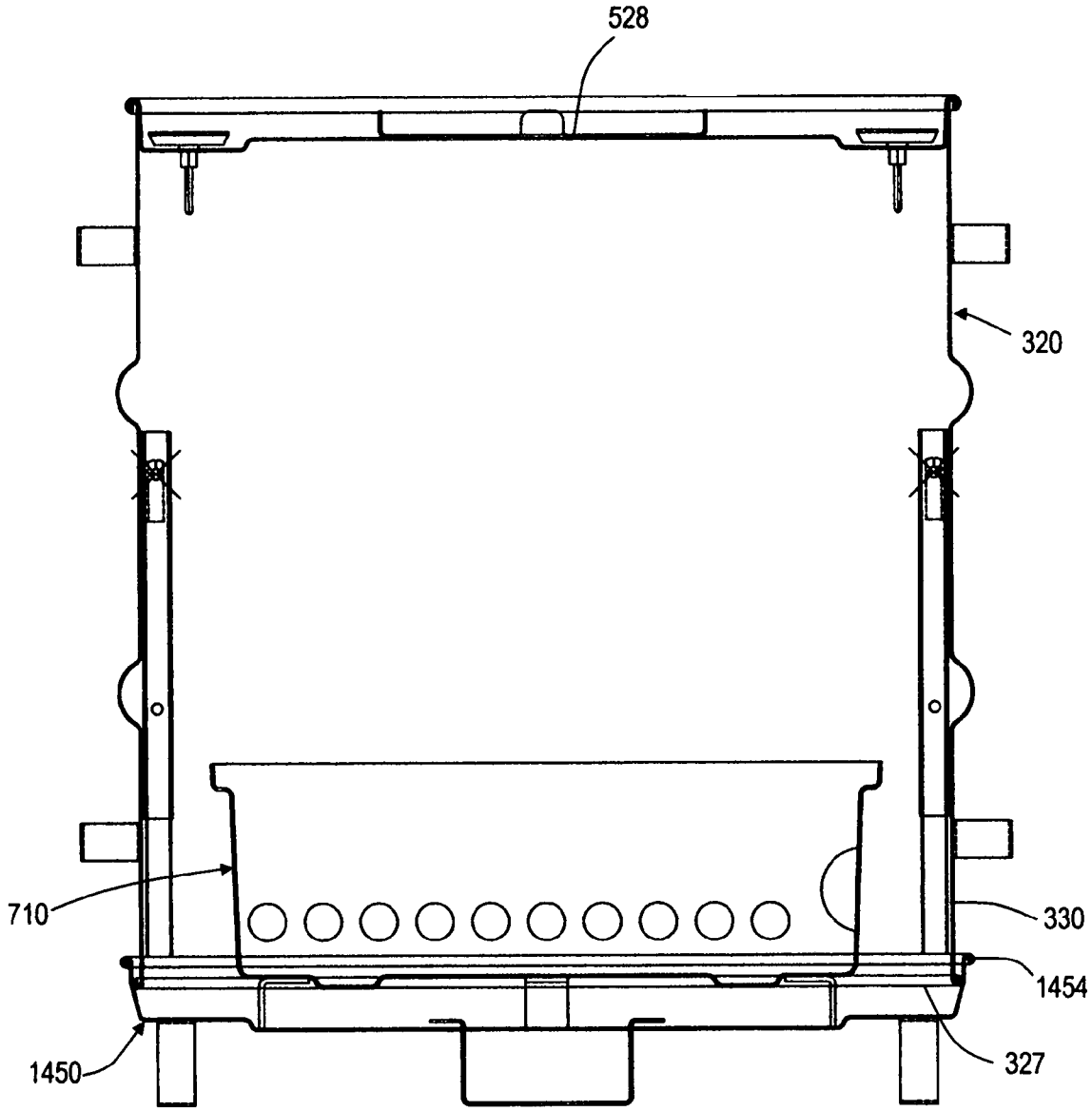
FIG. 17 shows a cross-sectional side elevation view of the embodiment of FIG. 16 with the Dutch ovens removed and the legs retracted.
Figure 18:
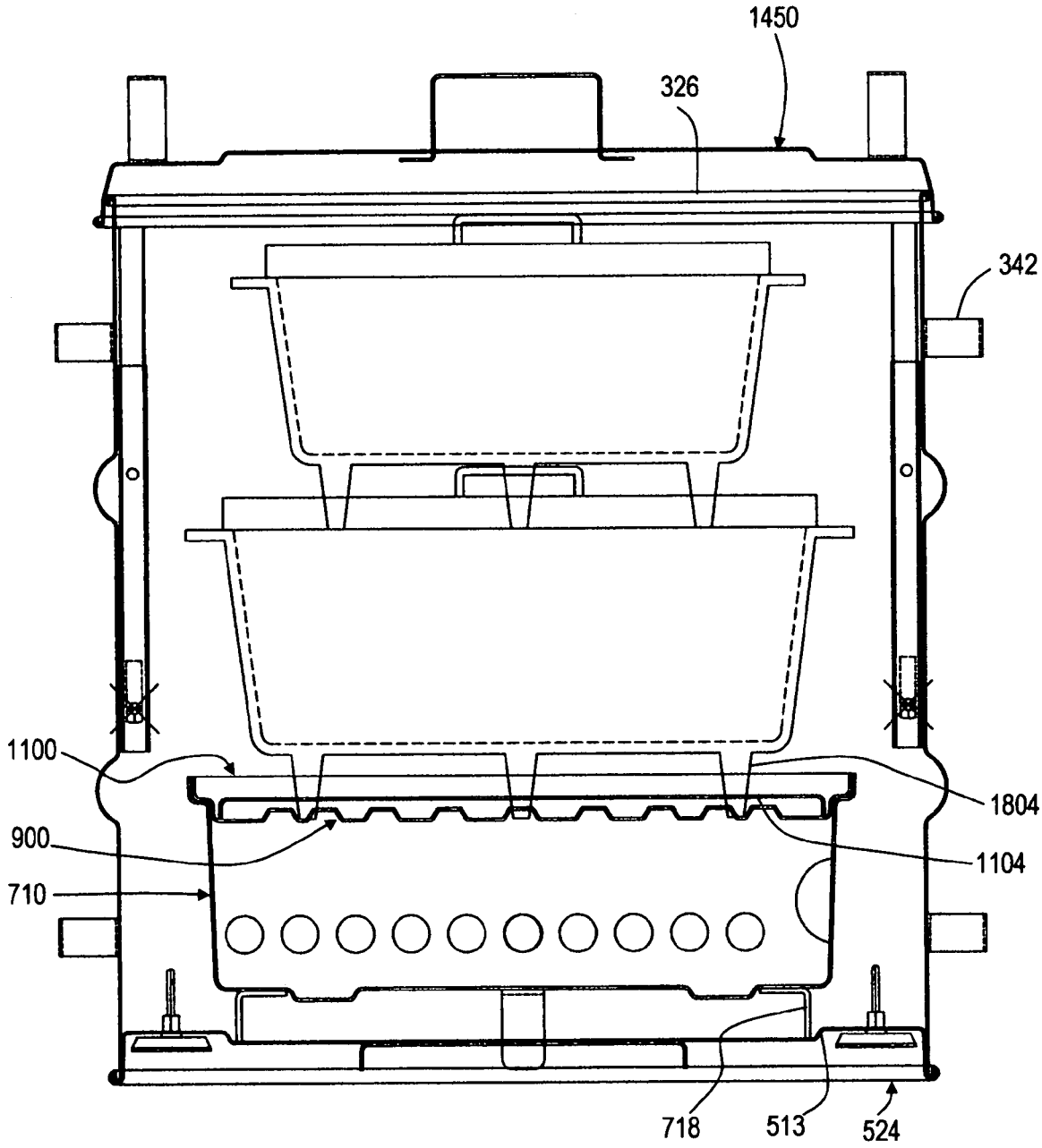
FIG. 18 shows a cross-sectional side elevation view of an embodiment in storage and transportation mode.

When all cooking is complete the fuel in the fire pan may be extinguished and the system allowed to cool. FIG. 17 shows a cross-sectional side elevation view of the embodiment of FIG. 16 with the Dutch ovens removed and the legs 330 retracted so that the lower edge 327 of the heating chamber 320 rests below the upper edge 1454 of the lid 1450. With the vent 528 closed and air flow thus cut off, fuel in the fire pan is extinguished and allowed to cool. As shown in the cross-sectional side elevation view of FIG. 18, the heating chamber 320 may then be removed and inverted, the baffle 900 and grill 1100 inserted into the fire pan 710, the fire pan 710 placed upon the end panel 524 with the feet 718 of the fire pan 710 resting within the step-down 513 in the end panel 524. A Dutch oven may be stacked upon the baffle 900 with the oven's feet 1804 passing through the elongated holes 1104 in the grill 1100 to rest upon the baffle 900. Generally, cookware and supplies may be stacked upon the baffle 900 and grill 1100 and/or within the heating chamber 320, then the lid 1450 may be placed over the lower edge 326 of the heating chamber 320 to contain cooking supplies and waste for convenient transportation. The whole assembly may then be conveniently carried by handles 342.

Figure 19:
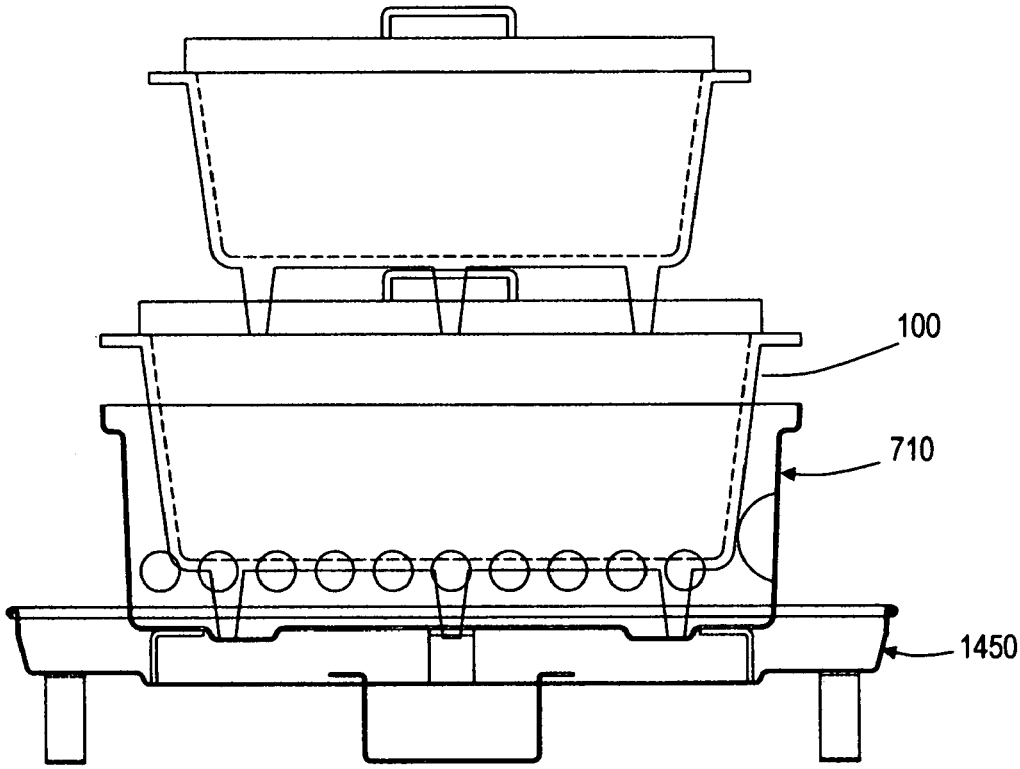
FIG. 19 shows a cross-sectional side elevation view of an embodiment without a heating chamber.

The components of the system described above can be reconfigured and used to advantage in many different cooking circumstances. For example, FIG. 19 shows a cross-sectional side elevation view of an embodiment without a heating chamber. The lid 1450 supports a fire pan 710 which contains a Dutch oven 100. This simple configuration allows easy access to the Dutch oven(s) in circumstances where wind protection and careful temperature control are not needed.

Figure 20:
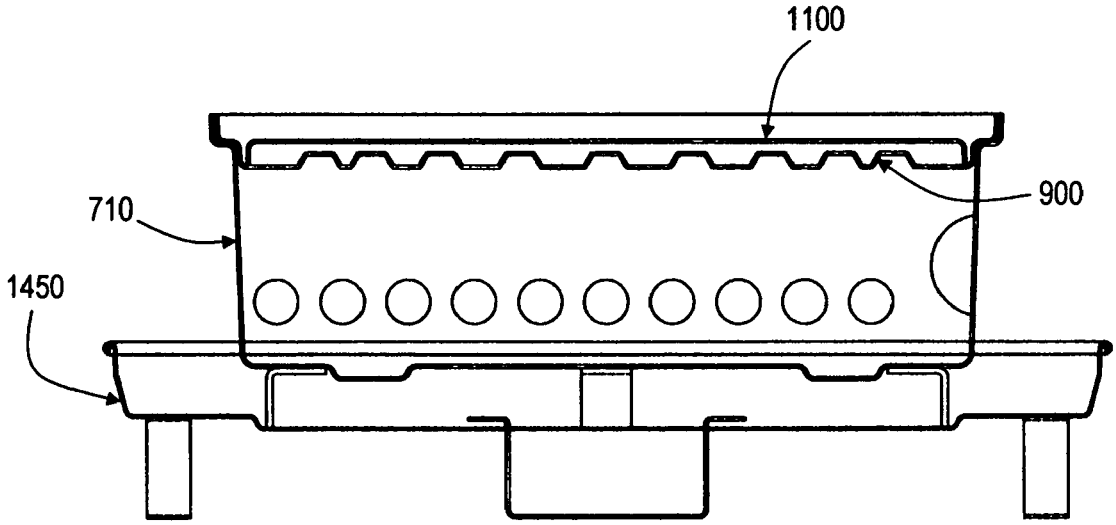
FIG. 20 shows a cross-sectional side elevation view of a baffle and grill installed in a fire pan that is resting on a lid.
Figure 21:
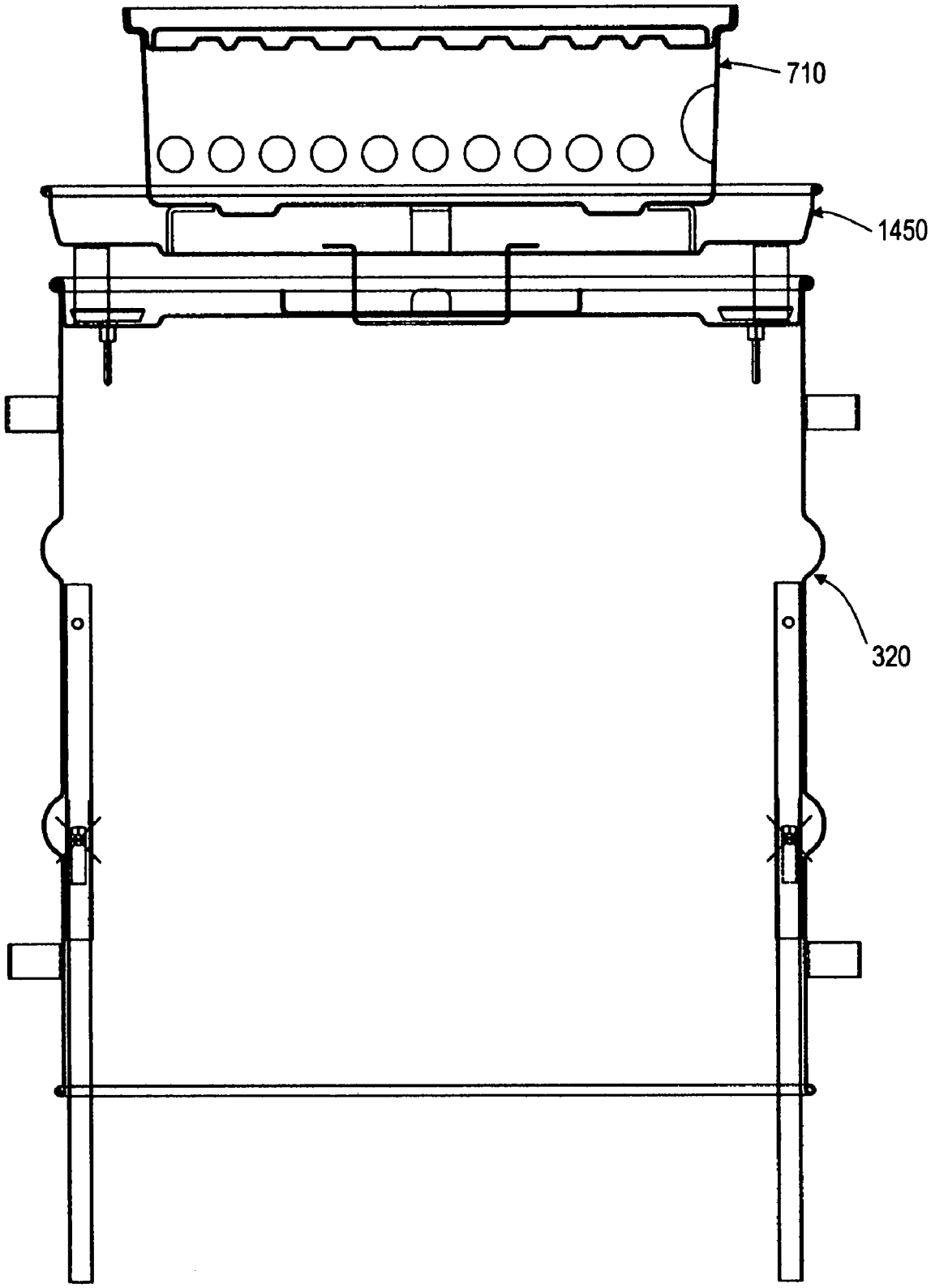
FIG. 21 shows the embodiment of FIG. 20 placed upon a heating chamber functioning as an adjustable-height cooking stand.

FIG. 20 shows a cross-sectional side elevation view of a baffle 900 and grill 1100 installed in a fire pan 710 that is in turn resting on a lid 1450. With a heat source inside the fire pan 710, this configuration functions as a portable grill. As shown in FIG. 21, the embodiment of FIG. 20 may be placed upon a heating chamber 320, with the heating chamber 320 functioning as an adjustable-height cooking stand.

Cooking environments where charcoal or wood are unavailable or where wood smoke is unacceptable may require the use of alternate heat sources. Compressed gasses such as propane or natural gas are widely available and convenient to use. Alternate embodiments of the invention may be easily adapted to use of compressed gas by the addition of a suitable burner as is known in the art.

Figure 22:
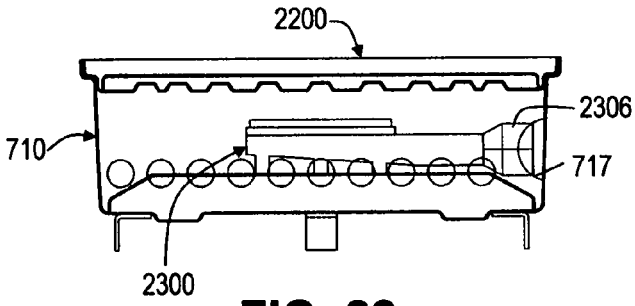
FIG. 22 shows a cross-sectional side elevation view of a gas grill.

FIG. 22 shows a cross-sectional side elevation view of a gas grill 2200 comprising the fire pan and grill assembly of FIG. 13 with a gas burner assembly 2300 inserted inside the fire pan 710. A fuel port 2306 as is known in the art is accessed through the access hole 717 in one side of the fire pan 710. Except for the substitution of the gas burner assembly 2300 in place of charcoal or wood, the gas grill 2200 is used in essentially the same cooking configurations as are used for charcoal or wood.

Figure 23:
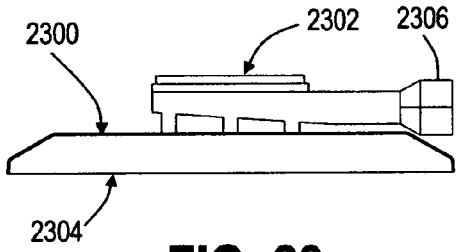
FIG. 23 shows a side elevation view of a gas burner assembly.
Figure 24:
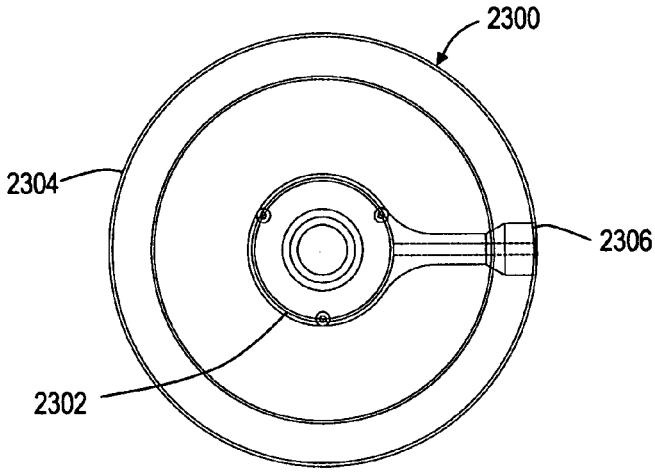
FIG. 24 shows a top plan view of the gas burner assembly of FIG. 23.

FIG. 23 shows a side elevation view of the gas burner assembly 2300. A burner 2302 with a fuel port 2306 is mounted on a base 2304 that fits within a fire pan. FIG. 24 shows a top plan view of the gas burner assembly 2300 of FIG. 23.

Figure 25:
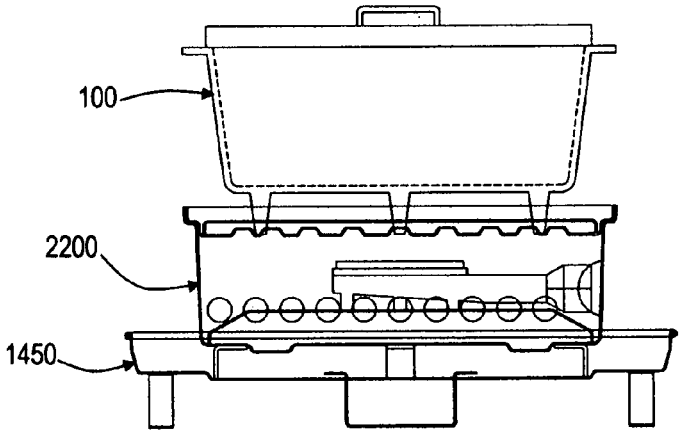
FIG. 25 shows a cooking configuration similar to that shown in FIG. 19 with a gas grill substituted for a charcoal grill.
Figure 26:
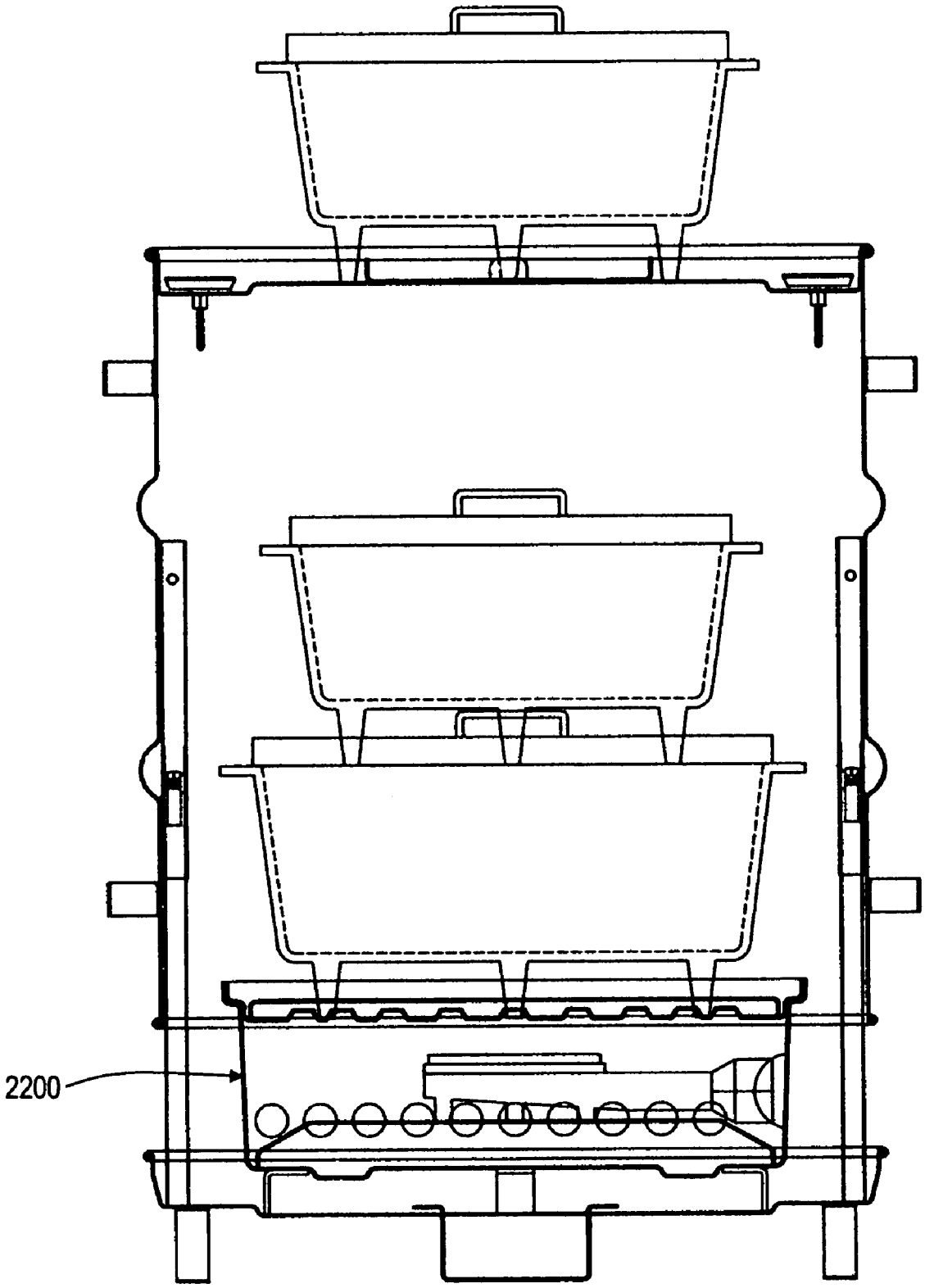
FIG. 26 shows a configuration similar to that shown in FIG. 16 with a gas grill substituted for a charcoal grill.

FIG. 25 shows a cooking configuration essentially the same as that shown in FIG. 19, with the substitution of the gas grill 2200 for a charcoal grill. In this embodiment the Dutch oven 100 rests atop the gas grill 2200 instead of within the fire pan 710. FIG. 26 shows a configuration essentially the same as that shown in FIG. 16, again with the substitution of a gas grill 2200.

Figure 27:
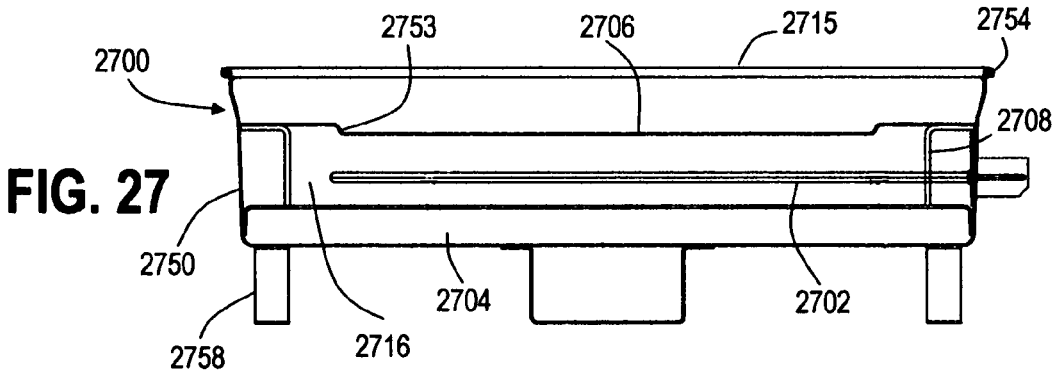
FIG. 27 shows a cross-sectional side elevation view of a lid assembly modified to include an electric heating element.
Figure 28:
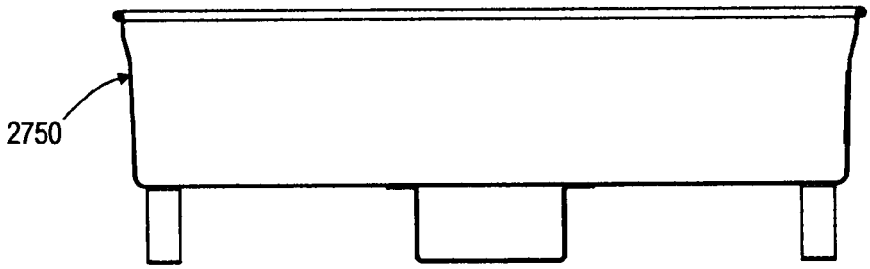
FIG. 28 shows a cross-sectional side elevation view of the modified lid of FIG. 27.
Figure 29:
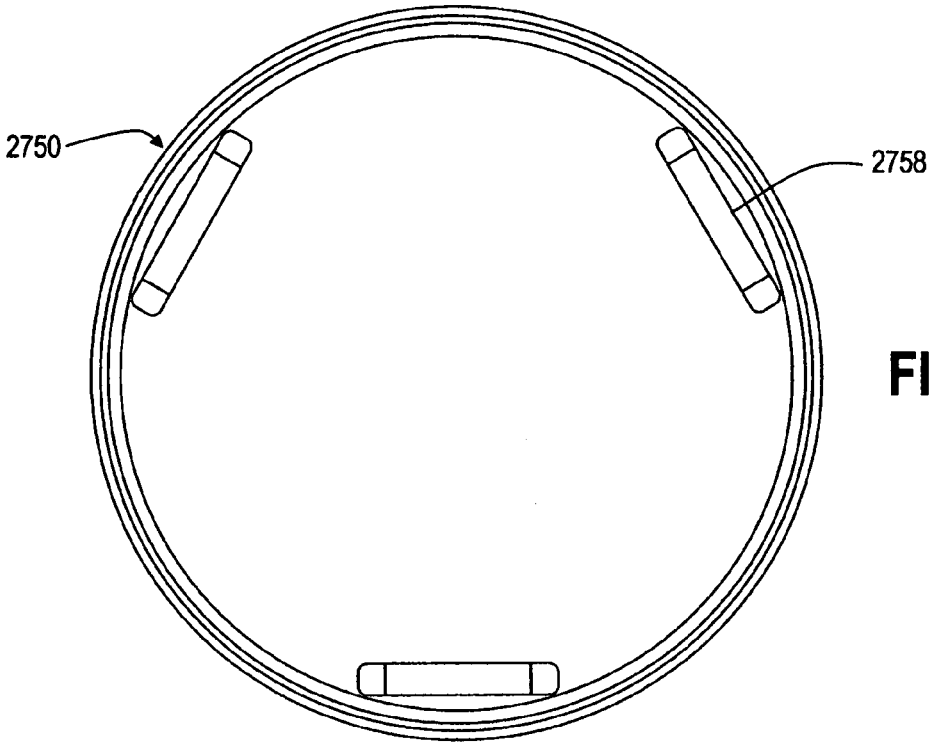
FIG. 29 shows a top plan view of the modified lid of FIG. 28.

An electric element may provide a heat source in circumstances where an open flame of any kind is undesirable or unacceptable. FIG. 27 shows a cross-sectional side elevation view of a lid assembly 2700 modified to include an electric heating element 2702. FIG. 28 shows a cross-sectional side elevation view of the modified lid 2750, which is deeper than the standard lid 1450. FIG. 29 shows a top plan view of the modified lid 2750 of FIG. 28. Returning to FIG. 27, the modified lid 2750 is supported by feet 2758. An insulator 2704 as is known in the art reduces heat lost to the supporting surface. A cavity 2716 surrounding the electric heating element 2702 may be filled with lava rock for general cooking or wood chips for smoking. A fire pan support 2706 with supporting legs 2708 and a centering step-down 2753 provides support for system components stacked atop the modified lid 2700. A rolled lip 2715 strengthens the upper edge of the modified lid 2700.

Figure 30:
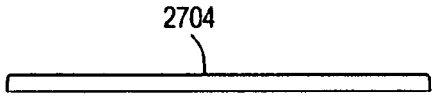
FIG. 30 shows a side elevation view of an insulator.
Figure 32:
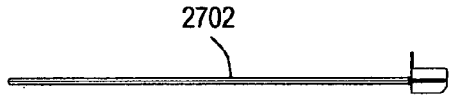
FIG. 32 shows a side elevation view of an electric heating element.
Figure 31:
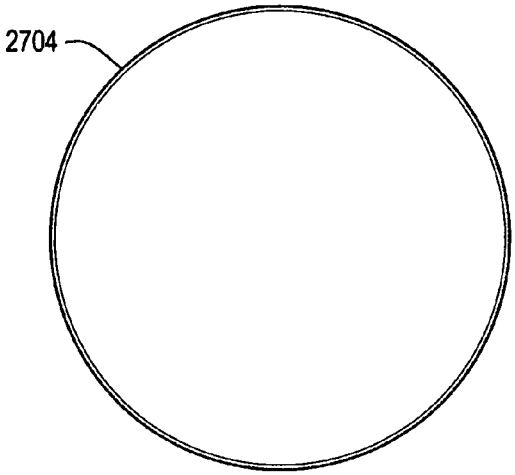
FIG. 31 shows a top plan of the insulator of FIG. 30.
Figure 33:
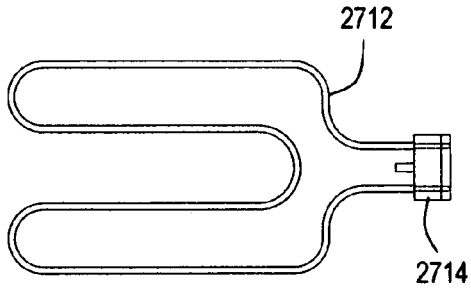
FIG. 33 shows a top plan of the electric heating element of FIG. 32.
Figure 34:
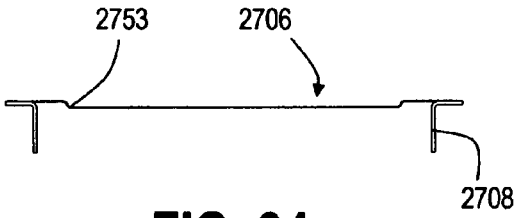
FIG. 34 shows a side elevation view of a fire pan support.
Figure 35:
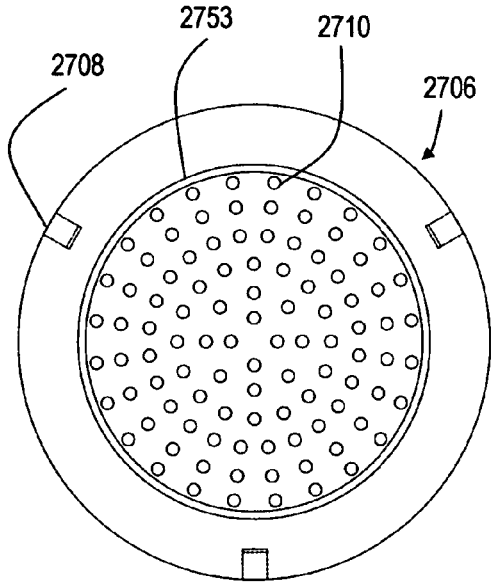
FIG. 35 shows a top plan of the fire pan support of FIG. 34.

FIGS. 30 and 31 show a side elevation view and a top plan of the insulator 2704, respectively. FIGS. 32 and 33 show a side elevation view and a top plan view of the electric heating element 2702, respectively. A 120 VAC, 1250 watt element is preferred, although with appropriate modifications others may be substituted as needed. The resistive element 2712 is connected to electrical power by a standard connector 2714. FIGS. 34 and 35 show a side elevation view and a top plan view of the fire pan support 2706, respectively. As shown in FIG. 35, the fire pan support 2706 is penetrated by an array of holes 2710 that allow heated air to pass upward from the electric heating element 2702 and materials within the cavity 2716.

Figure 36:
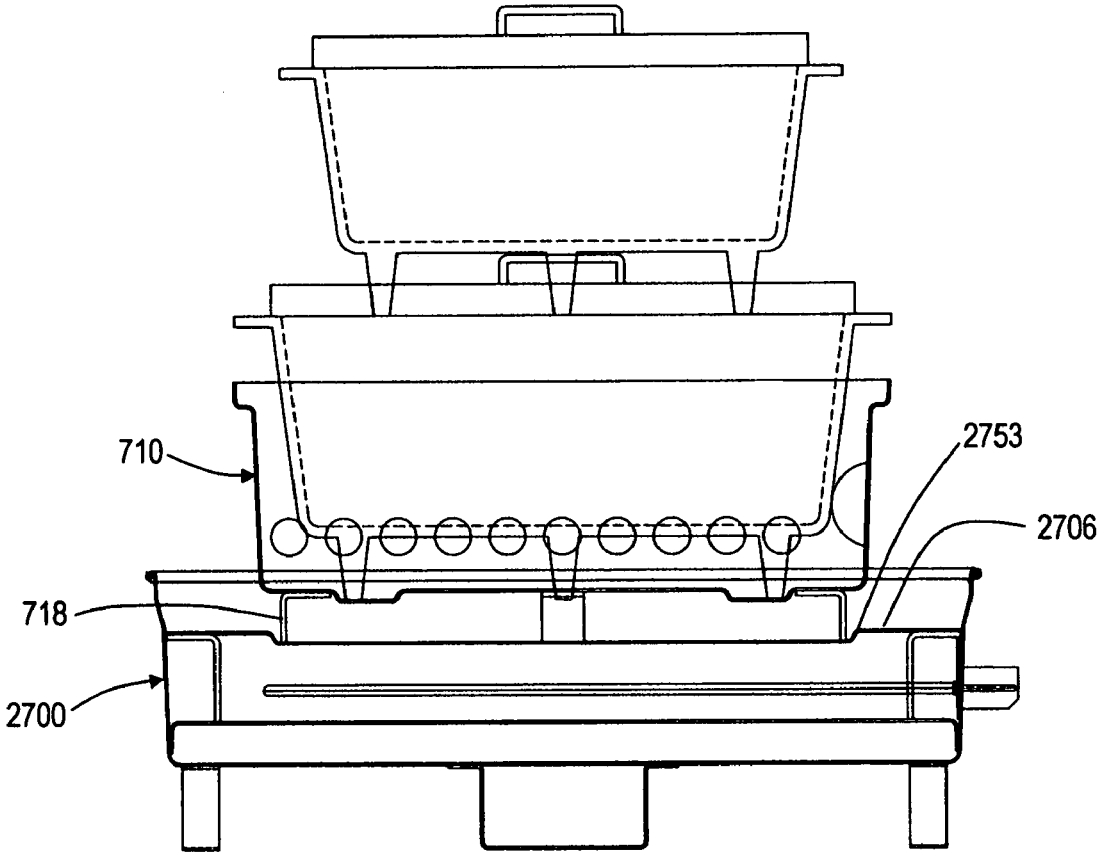
FIG. 36 shows side elevation view of an embodiment similar to that shown in FIG. 19, with the lid replaced by a modified lid.
Figure 37:
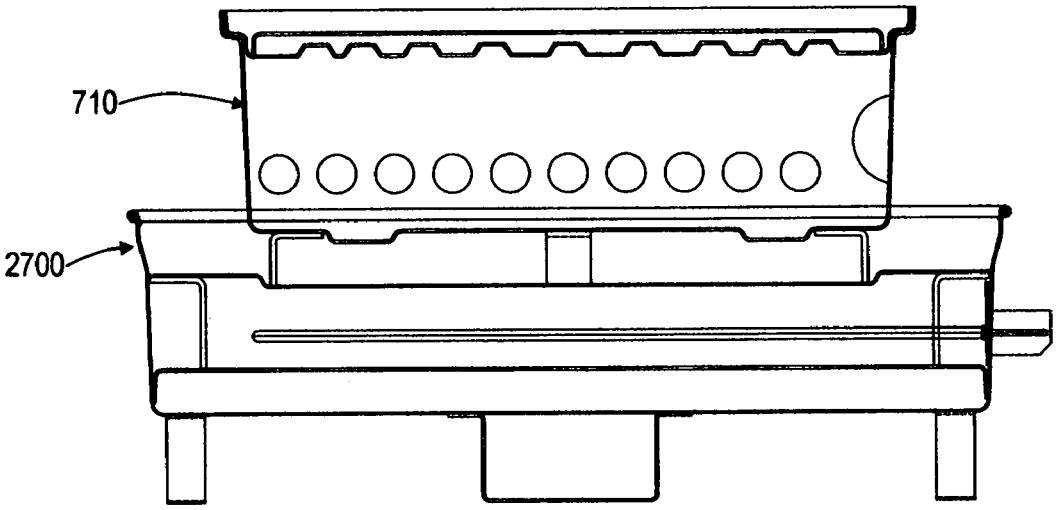
FIG. 37 shows a side elevation view of an embodiment similar to that shown in FIG. 20, with the lid replaced by a modified lid.
Figure 38:
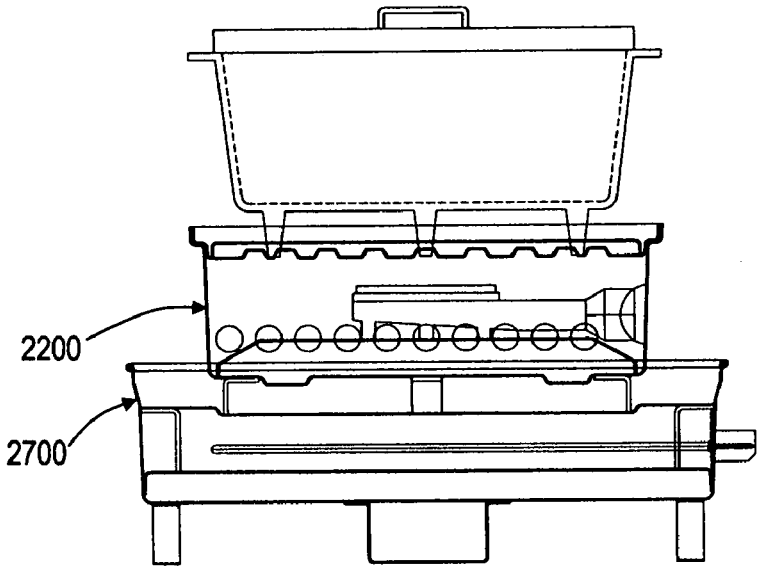
FIG. 38 shows a side elevation view of an embodiment with a modified lid supporting a gas grill.

FIG. 36 shows a side elevation view of a configuration essentially the same as that shown FIG. 19, with the lid 1450 replaced by a modified lid 2700 and the feet 718 of the fire pan 710 resting on the fire pan support 2706 just within the centering step-down 2753. FIG. 37 shows a side elevation view of a configuration essentially the same as that shown in FIG. 20, again with the substitution of the modified lid 2700. FIG. 38 shows still another configuration with the modified lid 2700 used to support the gas grill 2200, which in turn supports a Dutch oven. The heating chamber 320 may be used as a cooking stand as previously described. The modified lid 2700 may also be used in essentially the same transportation and storage configuration as previously described for the lid 1450.

Figure 39:
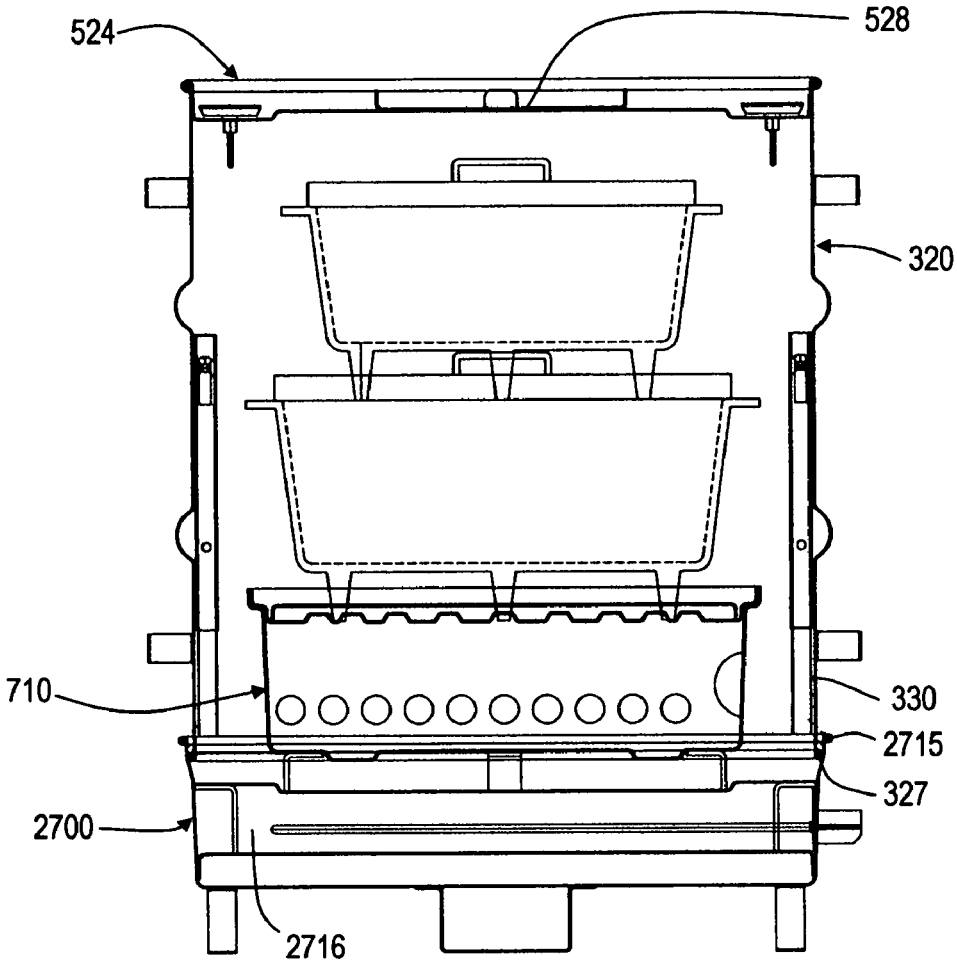
FIG. 39 shows an embodiment with heating chamber configured as an electric oven or smoker.

Since the electric heating element 2702 does not consume oxygen, the heating chamber 320 need not be raised for ventilation when used with the modified lid 2700. FIG. 39 shows side elevation view of a configuration in which the heating chamber 320 can be used as a true oven, with ventilation provided only by the vent 528 in the end panel 524. The legs 330 are retracted, allowing the lower edge 327 of the heating chamber 320 to drop below the upper edge 2715 of the modified lid 2700. This configuration may be used as an electric smoker by filling the cavity 2716 with wood chips.

As can be seen from the examples described above, the system components of the invention can be quickly reconfigured in many different ways to utilize a variety of fuels and cooking methods. After use the components may be stored in a compact container that prevents ash and other waster products from contaminating surroundings during transportation, so that the system may be packed up immediately and later cleaned in more convenient circumstances.

The principles of the invention have been set forth in the foregoing specification. The embodiments and modes of operation disclosed herein are exemplary and should be interpreted as illustrating the present invention rather than as restricting it. As is readily apparent from the foregoing description, an ordinary person could readily reconfigure the components of the invention in many ways implied by but not explicitly described in the foregoing description and figures. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

I claim:

1. A food preparation kit having component parts capable of being assembled in the field, the kit comprising the combination of:

a chamber, the chamber having an open end and a closed end, the chamber having at least two handles, at least a first exhaust vent, and at least three adjustable supporting legs;

a fire pan, the fire pan having at least a first vent hole, an access hole, and at least three supporting legs, the fire pan adapted to fit within the chamber;

a grill, the grill adapted to rest upon the fire pan, the grill adapted to fit within the chamber; and a lid, the lid comprising an insulator and an electric heating element, the lid adapted to support the fire pan, the lid further adapted to be retained in a position to close the open end of the chamber.

2. A method for maintaining a substantially consistent cooking temperature within a Dutch oven, comprising the steps of:

placing a lid upon a supporting surface;

placing a fire pan upon the lid;

placing a heat source within the fire pan;

placing a Dutch oven upon the fire pan;

adjusting supporting legs on a chamber to a position that will hold the lower edge of the chamber above the lid and at least slightly below the upper edge of the fire pan when the chamber is placed over the fire pan;

placing the chamber over the fire pan;

monitoring the interior temperature of the chamber with a thermometer; and adjusting an exhaust vent on the chamber to obtain and maintain a desired interior temperature in the chamber.

* * * * *